US005095400A

United States Patent [19]

Saito

[11] Patent Number: 5,095,400

[45] Date of Patent: Mar. 10, 1992

[54] METHOD AND APPARATUS FOR ELIMINATING STATIC ELECTRICITY

[75] Inventor: Toshio Saito, Tokyo, Japan

[73] Assignee: Saito Kohki Co., Ltd., Tokyo, Japan

[21] Appl. No.: 444,965

[22] Filed: Dec. 4, 1989

[30] Foreign Application Priority Data

Dec. 6, 1988 [JP] Japan ..... 63-309262
Aug. 14, 1989 [JP] Japan ..... 1-210356

[51] Int. Cl.[5] ..... H05F 3/00

[52] U.S. Cl. ..... 361/220; 361/212; 361/230

[58] Field of Search ..... 361/212, 220, 225, 226, 361/227, 230, 231, 232, 235

[56] References Cited

U.S. PATENT DOCUMENTS

| | | | |
|---|---|---|---|
| 3,794,839 | 2/1974 | Hayne | 250/324 |
| 4,517,143 | 5/1985 | Kisler | 361/225 |
| 4,713,724 | 12/1987 | Voelkel | 361/231 |
| 4,774,472 | 9/1988 | Blitshteyn et al. | 361/213 |
| 4,878,149 | 10/1989 | Stiehl et al. | 361/230 |

OTHER PUBLICATIONS

Handbook of Chemistry & Physics, 41st Edition, Published by Chemical Rubber Publishing Co., Cleveland, Ohio, p. 431.

*Primary Examiner*—A. D. Pellinen
*Assistant Examiner*—Jeffrey A. Gaffin
*Attorney, Agent, or Firm*—Burns, Doane, Swecker & Mathis

[57] ABSTRACT

The present invention is characterized by applying high positive and negative DC voltages supplied from a converter to positive and negative discharge needles (or electrodes) arranged independent of the other in two air passages to generate positive and negative corona ions in the two air passages, by supplying air, whose flow rates and pressures in the two air passages have been adjusted, into the air passages through air hoses connected to rear ends of the air passages, and by jetting the positive and negative ions, keeping them balanced, together with air to a charged body separated a little through nozzles attached to front ends of the air passages to eliminate static electricity from the charged body. The present invention is further characterized by method and apparatus capable of achieving the above-mentioned process and having an electrodes arrangement in which an extremely fine metal line made of tungsten, for example, and having a diameter of 20–60 μm is used as the corona electrodes to hold flows of the positive and negative ions balanced for a long time.

14 Claims, 3 Drawing Sheets

METHOD AND APPARATUS FOR ELIMINATING STATIC ELECTRICITY

BACKGROUND OF THE INVENTION

1. Field of the Invention

The present invention relates to a method and an apparatus for eliminating static electricity to prevent the trouble caused by static electricity.

More particularly, the present invention relates to a method and an apparatus of the ion supply type for creating positive and negative ions by corona discharge and spraying them onto a charged body whose load density is in imbalance to neutralize the load of the charged body and eliminate static electricity from the charged body.

Still more particularly, the present invention relates to a static electricity eliminating method an apparatus in which a new electrode arrangement is used to hold for a long time the balance of these positive and negative ions created.

The method and apparatus of the present invention can be employed to eliminate static electricity in type, offset and gravure printings, for example, silk screen and film processes, assembling and punching plastic and paper bags and the trimming plastics and papers to enable them to be used for wrappings and in the course of processing fibers, and also to eliminate static electricity from flowing grains as well as electronic components.

2. Description of the Prior Art

Most electronic components are usually broken into deficient ones by static electricity of about several hundreds volts. Further, static electricity, higher than several tens of kilovolts, is created on surfaces of plastic products and films. Therefore, they cause various kinds of troubles such as causing dust to stick to them. If even a piece of dust is stuck to a substrate by static electricity at the time when a semiconductor circuit is printed on the substrate, for example, the whole of the substrate will be regarded as a deficient one and cannot be used. Troubles like this caused by static electricity can be found everywhere in commercial, industrial and common lives and thus, it can be seen that static electricity is quite troublesome. Various kinds of measures have been thus employed to eliminate troubles caused by static electricity.

The static electricity eliminating means of the corona discharge type is one of these measures. The eliminator means of the corona discharge type can take one of several forms. One of them now used is of the selfdischarge type. In the case of the eliminator means of the self-discharge type, however, it is difficult to completely eliminate static electricity from charged bodies. Another method has been thus developed comprising creating ions by corona discharge and spraying them onto the charged body whose load is reverse in polarity to that of the ions to neutralize the load of the charged body or balance the load density thereof. This method is grouped in the alternating- and direct-current systems. It is the alternating-current system that is now more widely used.

The eliminator means of the alternating-current (AC) type is intended to convert the commercial power of AC 100V (Japanese standard) to a high AC voltage of 5–10Kv by means of a converter and/or transformer and the like, apply it to the discharge electrode (or discharge needle) to create corona around the electrode, and create positive and negative ions alternately due to this corona phenomenon to supply them to the charged body. As the result, static electricity carried by the charged body is neutralized by ions sprayed, and eliminated from the charged body.

The above-described eliminating method and means of the AC type is disclosed in Japanese Utility Model Publications Sho 34-13629, 38-18505, 40-16334, 41-11945 and 55-15278, Japanese Utility Model Pre-Publications Sho50-32967, 50-131964 and 51-39476, Japanese Patent Publication Sho 43-16026, and Japanese Patent Pre-Publications Sho 58-225600 and 59-12600.

In the case of the static electricity eliminating method of the AC type, static electricity carried by the charged body can be eliminated whichever polarity the load of the charged body may have. However, positive and negative ions created combine partly with one another again. Because positive and negative ions are alternately created through the same corona discharge needle, ions whose polarities are different from one another are liable to be neutralized in the vicinity of the corona discharge needle. Therefore, the amount of ions useful for eliminating static electricity is small, which means that the ability of eliminating static electricity is low in the case of the eliminating method of the AC type.

Further, ions created around the electrode interfere with one another to lower the effect of eliminating static electricity as frequency is made higher. As frequency is made lower, however, it becomes more difficult to uniformly eliminate static electricity carried by the charged body. In other words, the effect of eliminating static electricity cannot be expected.

Furthermore, the polarity of current changes every cycle and positive and negative ions are thus alternately and intermittently created. Therefore, the amount of ions becomes sometimes short, depending upon the load density of the charged body to be processed, thereby lowering the effect of eliminating static electricity.

There has been well known the eliminator means of the direct-current (DC) type, which is intended to apply high DC voltage to the discharge electrode to create ions of a single polarity. The eliminator means of the DC type can thus eliminate the abovementioned drawbacks of the one of the AC type eliminating method.

According to the eliminator means of the DC type, a lot of ions useful for eliminating static electricity can be generated to enable the eliminator means to have a quite higher capacity of eliminating static electricity. However, ions having only a single polarity, positive or negative, can be generated and when the polarity of the load carried by the charged body is same as that of ions created,.therefore, the eliminator means cannot be applied to this charged body. This is the reason why the eliminator means of the amphoteric discharge type has been provided to use DC electrodes as discharge ones to generate positive and negative ions at the same time.

Even in the case of the eliminator means of the amphoteric, discharge type, it is necessary that the flow of ions be balanced depending upon the polarity and load density of the charged body, and this technique of balancing the flow of ions is disclosed in Japanese Patent Pre-Publication Sho 57-11499.

The inventor of the present invention has studied the technique of balancing the flow of ions and found that the effect of holding the flow of ions balanced lasts for a quite short time, that is, two months or less in the case of the conventional apparatus.

After studying the cause of this drawback from various viewpoints, the inventor has found that this drawback is caused by the electrode through which corona is generated. More specifically, a needle-like metal having a sharp tip is used as the conventional corona discharge electrode and when corona discharge is repeatedly carried out through this electrode, load particles adhere and deposit on the stepped shoulder of the electrode which is adjacent to the tip of the electrode, thereby causing electrolytic corrosion at the stepped shoulder of the electrode. This is the reason why the effect of holding the flow of ions balanced lasts only for a short time.

This was not seen in the case of the eliminator means of the AC type. The reason is supposed to reside in that alternately applied positive and negative ions repel load particles, whichever polarity the load particles may have, to prevent the load particles from depositing on the electrode. The load particles deposited because of corona discharge conducted through the electrode for a long time add electrochemical effect to the electrode and cause the electrode to be electrolytically corroded. This electrolytic corrosion is supposed to make quite short the lasting of the effect of holding the flow of ions balanced. In the case of applying DC voltage, no force acts to prevent the load particles from depositing on the electrode.

SUMMARY OF THE INVENTION

A method of eliminating static electricity according to the present invention is characterized in comprising outputting high positive and negative DC voltages independently of the other through a converter and/or transformer, applying the high positive DC voltage to a positive discharge electrode while applying the high negative DC voltage to a negative discharge electrode to generate positive and negative corona ions independently of the other in two air passages, and creating flows of ions by air, which is supplied under the state that its flow rate and pressure are adjusted, to adjust the balance of positive and negative ions.

An apparatus for eliminating static electricity according to the present invention comprises a converter for outputting high positive and negative DC voltages, two air passages each having a injection nozzle connected to its front end and an air hose connected to its rear end, positive and negative corona discharge electrodes arranged independently in the two air passages, and a means for adjusting flow rates and pressures of air in the two air passages, wherein the balance of positive and negative ions can be adjusted.

The present invention is further characterized in that an extremely fine metal line having a diameter of 20–60 μm is used as the corona discharge electrode to keep the flow of positive and negative ions balanced for a long time. An apparatus embodied to meet this characteristic of the present invention comprises a means for applying high DC voltages to positive and negative corona discharge electrodes arranged independently of the other to generate flows of positive and negative ions, a means for supplying the flows of ions to a charged body whose load density is not uniform, and a means for adjusting the balance of each ion flow, wherein the positive and negative electrodes of said ion generating means are located in ion flows generating sections separated from each other and independent of the other and spaces in the ion flows generating sections are communicated with each other through discharge passages in nozzles and wherein each of the electrodes is an extremely fine metal line having a diameter of 20–62 μm and made of tungsten, tantalum and an alloy including them.

In the case of eliminating static electricity, high positive and negative DC voltages outputted through the converter and/or transformer are applied to their respective positive and negative corona discharge electrodes. Positive corona ions are generated through the positive corona discharge electrode while negative corona ions through the negative corona discharge electrode. When the positive and negative corona ions thus generated are jetted to a charged body, together with air supplied under such a state that its flow rate and pressure are adjusted, the corona ions reach the charged body positioned remote from them, keeping their balance, and static electricity carried by the charged body is electrically neutralized and eliminated by them, whichever polarity the static electricity may have.

When flow rates and pressures of air in two air passages are adjusted in this manner, the balance of positive and negative ions can be easily adjusted. In addition, static electricity can be eliminated at high speed, using low air pressure and low voltage.

According to the present invention, high positive and negative DC voltages outputted through the converter which is connected to an AC or DC power source (or the primary side thereof) are used as high DC voltages applied to corona discharge electrodes. The so-called double DC system (see Japanese Patent Pre-Publication Sho 61-290699) is employed to carry out discharge. The double DC system comprises connecting the first discharge electrode to a DC power source of one polarity and the second discharge electrode to a DC power source of the other polarity, and it is intended to generate an electric field not between each of the electrodes and the ground but between the electrodes whose polarities are reverse to each other. When an electric field is generated between the electrodes in this manner, corona discharge is caused at the front end of each of the electrodes to ionize air between the electrodes.

Extremely fine metal lines each being fixed at one end thereof and having a diameter of 20–62 μm and made of tungsten, tantalum and an alloy including them are used as a pair of the corona discharge electrodes to which positive and negative voltages are applied. Each of the metal lines which serve as the electrodes has the same diameter As is apparent from the above, an object of the present invention is to provide a method and an apparatus for eliminating static electricity, wherein high positive and negative DC voltages are used and corona discharge electrodes to which these voltages are applied are arranged, independent of the other, in two air passages in which flow rates and pressures of air can be adjusted, so that static electricity can be eliminated at high speed, using low air pressure and low voltage, and that the balance of positive and negative ions can be easily adjusted.

Another object of the present invention is to provide a method and an apparatus for eliminating static electricity, wherein an electrode arrangement is employed to enhance to a great extent the effect of holding flows of positive and negative ions balanced.

These and other objects as well as the merits of the present invention will become apparent from the following detailed description with reference to the accompanying drawings.

DETAILED DESCRIPTION OF THE PREFERRED EMBODIMENT

Figure 1:
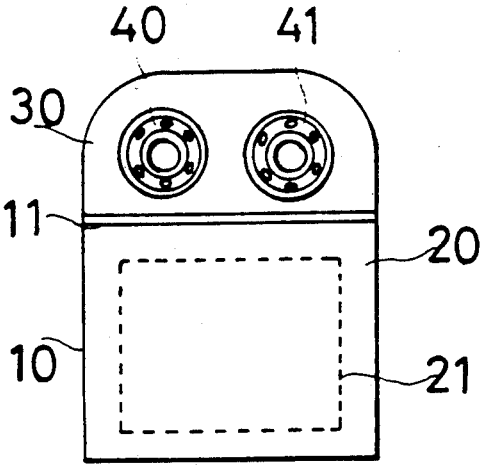
FIG. 1 is a front view showing an example of the eliminator apparatus according to the present invention.
Figure 2:
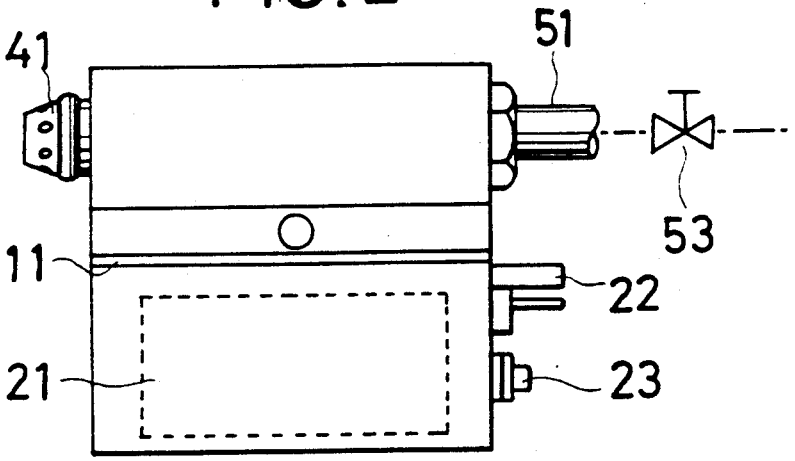
FIG. 2 is a right side view showing the apparatus.
Figure 3:
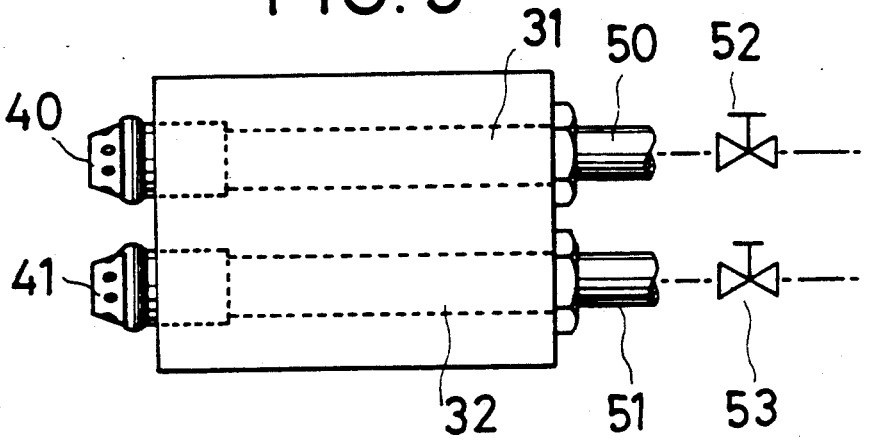
FIG. 3 is a plan view showing the apparatus.
Figure 4:
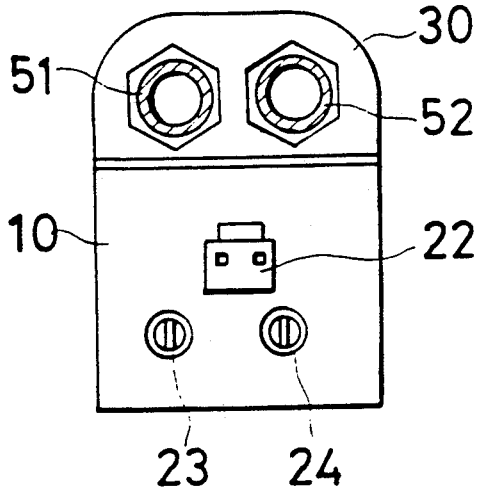
FIG. 4 is a rear side view showing the apparatus.
Figure 5:
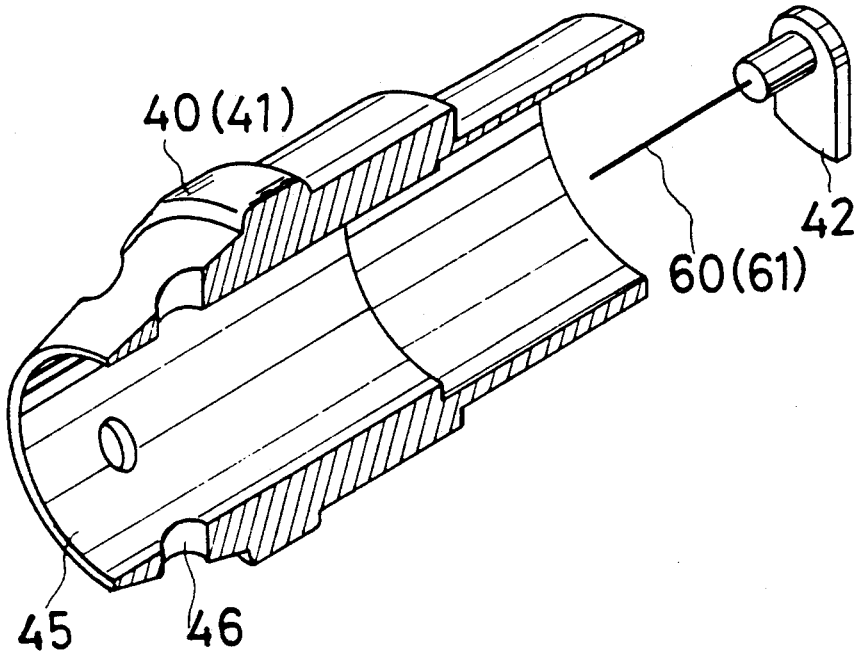
FIG. 5 is an isometric view showing the inside of a nozzle.

An embodiment of the present invention will be described in detail with reference to the drawings.

In the drawings, reference numeral 10 denotes a housing in which a power source means 20 is housed. The power source means 20 includes a converter 21, a transformer (not shown) and the like, and the converter 21 serves to convert alternating current of 100v-200v and 50 Hz-60 Hz supplied from the commercial AC power source or direct current of 1.5v-100v supplied from the DC power source in Japan to high positive and negative DC voltages of 2-5 Kv. Arranged on the rear side of the housing 10 are a connector 22 for connecting the power source means 20 to the power source outside, and members 23 and 24 for adjusting positive and negative voltages outputted through the converter. A block 30 is attached to the top of the housing 10 with a partition plate 11 interposed between them.

Two air passages 31 and 32 are formed in the block 30, extending along the longitudinal center axis of the block 30, and nozzles 40 and 41 are attached to the foremost ends of air passages 31 and 32, respectively, while air hoses 50 and 51 to the rear ends thereof through hose fittings to connect the air passages 31 and 32 to a compressor (not shown). Flow rate adjusting valves 52 and 53 are attached to the air hoses 50 and 51, respectively.

Figure 6:
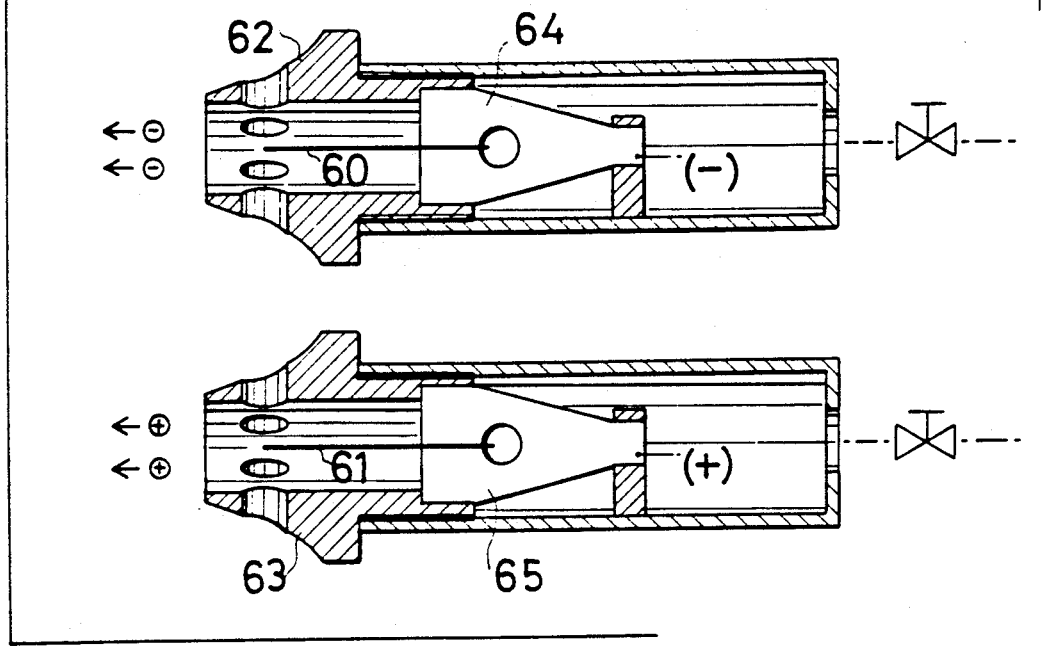
FIG. 6 is a sectional view showing the inside of the apparatus.

As shown in FIG. 6, pipe-like members made of metal or synthetic resin may be fixed to the rear ends of nozzles 40 and 41 instead of the air passages 31 and 32 formed in the block 30.

A terminal plate 42 is positioned on the front side of each of the air passages 31 and 32 or in the nozzles 40 and 41 and bases of discharge electrodes 60 and 61 are fixed to the centers of the terminal plates 42.

As apparent from FIGS. 1 through 3 and FIG. 5, an ion passage 45 which also serves as the air passage is formed in the center of each of the nozzles 40 and 41, and air-plunging holes 46 are formed, around the nozzles 40 and 41 at equal intervals..

Air hoses 50 and 51 extending from the air compressor (not shown) are connected to the air passages 31 and 32 through hose fittings, and the apparatus is set to direct the nozzles 40 and 41 toward a charged body positioned remote from the apparatus.

High positive DC voltage is applied to one of the discharge electrodes 60 and 61 and high negative DC voltage to the other thereof, while adjusting these voltages through the operation members 23 and 24. Air is fed, at the same time, into the air passages 31 and 32 at a certain flow rate through the flow rate adjusting valves 52 and 53. As a result, positive corona ions are generated through the positive discharge electrode 61 while negative corona ions through the negative discharge electrode 60. Positive and negative corona ions thus generated are jetted together with air whose flow is adjusted by the flow rate adjusting valves 52 and 53, to the charged body, which is positioned remote from or separated by 0.2-2m from the apparatus, through nozzles 40 and 41. Static electricity carried by the charged body is thus electrically neutralized and eliminated by positive or negative corona ions, whichever polarity the static electricity may have.

The positive and negative discharge electrodes 60 and 61 are arranged independent of one another, as described above. Therefore, positive and negative corona ions interfere quite little with one another. Further, the apparatus is designed to use the potential difference between the positive and negative discharge electrodes 60 an 61. This enables static electricity to be effectively eliminated even when relatively low voltages of DC 2-5 Kv are applied to the electrodes. Furthermore, when high DC voltages which are applied to the positive and negative discharge electrodes 60 and 61 arranged independent of one another are adjusted, the balance of positive and negative ions can be easily adjusted. As a result, the distance effective to eliminate static electricity can be increased and static electricity carried by a charged both that is more remote can be eliminated.

Still further, the discharge electrodes 60 and 61 are arranged in the air passages 31 and 32 in which the flow rate of air can be adjusted. When the flow rate and pressure of air are adjusted, therefore, the balance of positive and negative ions can be more easily adjusted and the distance effective to eliminate static electricity can be increased. Static electricity can be thus eliminated at high speed, using low air pressure and DC voltage. This enhances the economy and safety of the apparatus.

The present invention is not limited to the above-described embodiment. Although two air passages have been formed extending parallel to each other in the case of the above-described embodiment, means for the positive and negative corona discharge electrodes may be made rotatable and independent of one another. When air-jetting directions are adjusted while rotating the positive and negative corona discharge electrodes means, therefore, the balance of positive and negative ions can be adjusted.

Pressure adjusting valves may be attached to the air hoses instead of the flow rate adjusting valves. When the pressure of air is adjusted by the pressure adjusting valves, the balance of ions can be adjusted.

It may be arranged that two air passages are connected together at the rear ends thereof, that an air hose is connected to this connected portion of the two air passages, and that a pressure or flow rate adjusting valve is attached to this air hose.

The present invention can also be applied to those cases where the paired two air passages are arranged side by side at a certain interval, where they are arranged symmetrical in relation to a point, or where they are arranged on an arc.

Figure 7:
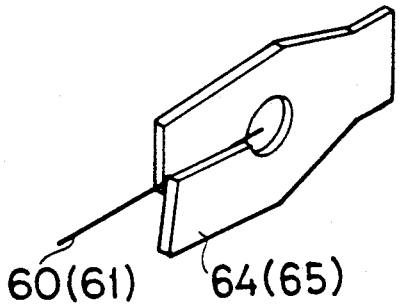
FIG. 7 is a perspective view of one system for holding the electrode.
Figure 8:
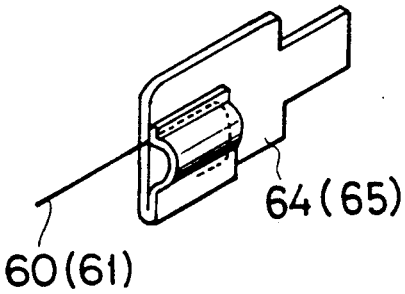
FIG. 8 is a perspective view of another system for holding the electrode.

FIGS. 6 through 8 show how the electrodes are held in the apparatus. The housing, power source means, converter, connector, operation members, block, air passages, air hoses, adjusting valves and the like in the case of the apparatus shown in FIG. 6 are fundamentally the same as those in the above-described embodiment and in its variations.

The apparatus shown in FIG. 6 is characterized by its electrodes and arrangements for holding the electrodes. As apparent from FIG. 6, each of discharge electrodes 60 and 61 is an extremely fine metal line fixed at one end thereof, having a diameter of 20–60 μm and made of tungsten, tantalum or an alloy including these metals.

As shown in FIG. 6, the bases of the discharge electrodes 60 and 61 are fixed to metal holders 64 and 65 which are supported by the terminal plate. The terminal plate is fixed to and electrically insulated from sleeves which are also fitted onto the rear ends of the nozzles 62 and 63.

As shown in FIG. 7, each of the holders 64 and 65 is divided into two parts like a pen tip, these two parts of the holder are overlapped one upon the other, and the base of the discharge electrode is fixedly sandwiched between these overlapped portions of the two parts of the holder.

Figure 9:
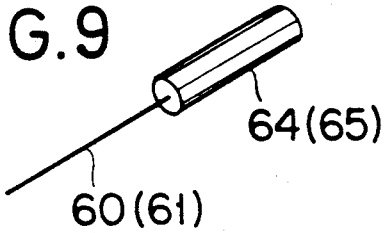
FIG. 9 is a perspective view of another system for holding the electrode.

The discharge electrodes 60 and 61 can be fixed to the holders 64 and 65 in various ways. As shown in FIG. 8, a part of each of the holders 64 and 65 may be formed like a clip and that the discharge electrode can be fixed to the holder by the elasticity of the clip-shaped part of the holder. As shown in FIG. 9, the base of each of the discharge electrodes 61 may be molded together with a lead line, using metal or synthetic resin, and the molded portions of the discharge electrodes 60 and 61 can then be fixed to the holders 64, 65 supports.

The most important matter of each of the discharge electrodes 60 and 61 is that those portions of the electrodes which extend forward from the holders 64 and 65 are not made sharp except at their foremost ends.

The apparatus is set to direct its nozzles 62 and 63 toward a charged body with a distance of about 0.2–2m interposed between the nozzles and the charged body, and high positive DC voltage is applied to the positive electrode while high negative DC voltage is applied to the negative electrode. Outputs (positive and negative voltages) supplied through the converter are adjusted at this time by the operation members 23 and 24.

Before or at the time when these voltages are applied to the electrodes, compressed air is supplied from the compressor through the air hoses 50 and 51 and jetted through the nozzles 62 and 63.

The apparatus is of the so-called double DC type. Therefore, an electric field is generated between both of the discharge electrodes 60 and 61 whose polarities are reverse to each other. When an electric field is generated in this manner, corona discharge is created at the front end of each of the electrodes to ionize air between the electrodes. The reason why an electric field is formed between the electrodes is not entirely known yet, but it may be because the plural air plunging holes 46 serve as zones through which electrons move.

Air present on the side of the positive electrode 61 is ionized positive while air on the side of the negative is ionized electrode 60 negative. Positive ions thus generated are mixed with compressed air to form a flow of positive ions and this flow of positive ions is jetted through nozzle 63. On the other hand, negative ions are mixed with compressed air to form a flow of negative ions and this flow of negative ions is jetted through the nozzle 62.

The flow rates of air flowing through the nozzles 62 and 63 are adjusted by the adjusting valves 52 and 53.

When the flows of positive and negative ions are sprayed onto those portions of the charged body on which the load is not uniform, the load carried by the charged body is made uniform and neutralized.

(Test)

Flows of ions were generated and tests to neutralize the load of charged bodies with the flows of ions were conducted to examine the static electricity eliminating effect achieved by the apparatus of the present invention.

Materials and diameters of the electrodes 60 and 61 and voltages (DC) applied to the electrodes were set as shown in Table 1.

(Evaluation)

The lasting of ion flows was evaluated by examining how the effect of neutralizing the static electricity of charged bodies with ion flows jetted diminishes. Results are shown in Table 1.

When the diameter of each of the electrodes 60 and 61 was in a range of 20–60 μm (test nos. 1–8), it was found that the balance of ion flows lasted longer than two months. When the diameter was in a range of 20–30 μm (test nos. 1–3), it was found that the balance of ion flows lasted twelve months.

When the diameter was 80 μm (test no. 9), however, it was found that the balance of ion flows did not last even one month.

TABLE 1

| TEST No. | BOTH ELECTRODES MATERIAL | DIAMETER (μm) | VOLTAGE APPLIED (DC) | LASTING OF BALANCED ION FLOWS (MONTH) 1 | 2 | 3 | 6 | 12 |
|---|---|---|---|---|---|---|---|---|
| 1 | TUNGSTEN | 20 | +4000 v<br>−4000 v | ◎ | ◎ | ◎ | ◎ | ◎ |
| 2 | TUNGSTEN | 25 | +4000 v<br>−4000 v | ◎ | ◎ | ◎ | ◎ | ○ |
| 3 | TUNGSTEN | 30 | +4000 v<br>−4000 v | ◎ | ◎ | ◎ | ◎ | ○ |
| 4 | TUNGSTEN | 35 | +4000 v<br>−4000 v | ◎ | ◎ | ◎ | ○ | Δ |
| 5 | TUNGSTEN | 40 | +4000 v<br>−4000 v | ◎ | ◎ | ◎ | ○ | Δ |
| 6 | TUNGSTEN | 45 | +4000 v<br>−4000 v | ◎ | ◎ | ○ | ○ | Δ |
| 7 | TUNGSTEN | 50 | +4000 v<br>−4000 v | ◎ | ◎ | ○ | Δ | X |
| 8 | TUNGSTEN | 60 | +4000 v<br>−4000 v | ◎ | ○ | Δ | X | X |

TABLE 1-continued

| TEST No. | BOTH ELECTRODES MATERIAL | DIAMETER (μm) | VOLTAGE APPLIED (DC) | LASTING OF BALANCED ION FLOWS (MONTH) 1 | 2 | 3 | 6 | 12 |
|---|---|---|---|---|---|---|---|---|
| 9 | TUNGSTEN | 80 | +4000 v<br>−4000 v | ○ | Δ | X | X | X |

◎: Neutralizing effect is quite excellent. No electrolytic corrosion is found on electrodes
○: Neutralizing effect excellent. Almost no electrolytic corrosion is found on electrodes
Δ: Neutralizing effect is not excellent. Electrolytic corrosion is found on electrodes.
X: No neutralizing effect is found. Quite a lot of electrolytic corrosion are found on electrodes.

What is claimed is:

1. An apparatus for eliminating static electricity comprising:

a converter for outputting high positive and negative DC voltages;

two air passages, each of which has an injection nozzle at the front end thereof and an air hose at the rear end thereof;

a positive corona discharge electrode arranged in one of the air passages and a negative corona discharge electrode arranged in the other air passage, said electrodes being fabricated from metal line having a diameter of about 20 μm–60 μm;

means for adjusting an air flow rate and an air pressure in each of the passages;

means for applying high DC voltages to the positive and negative electrodes to generate a flow of positive ions and a flow of negative ions;

means for supplying the flow of positive ions and the flow of negative ions to a charged body whose load density is non-uniform; and means for adjusting the balance of the flow of negative and positive ions through the air passages and out the nozzle, said positive and negative electrodes being arranged in ion flow generating sections that are independent from one another, spaces in the ion flow generating sections being communicated with each other through a discharge passage formed in each of the nozzles.

2. The apparatus according to claim 1, wherein the corona discharge electrodes are made of tungsten.

3. The apparatus according to claim 1, wherein each of the discharge electrodes is supported only at one end thereof.

4. The apparatus according to claim 2, wherein the positive and negative corona discharge electrodes have the same diameter.

5. The apparatus according to claim 1, wherein the corona discharge electrodes are made of tantalum.

6. The apparatus according to claim 5, wherein each of the discharge electrodes is supported only at one end thereof.

7. The apparatus according to claim 5, wherein the positive and negative corona discharge electrodes have the same diameter.

8. The apparatus according to claim 1, wherein the corona discharge electrodes are made of an alloy including tungsten and tantalum.

9. The apparatus according to claim 8, wherein each of the discharge electrodes is supported only at one end thereof.

10. The apparatus according to claim 8, wherein the positive and negative corona discharge electrodes have the same diameter.

11. The apparatus according to claim 1, wherein each of the discharge electrodes is supported only at one end thereof.

12. The apparatus according to claim 11, wherein the positive and negative corona discharge electrodes have the same diameter.

13. The apparatus according to claim 1, wherein the positive and negative corona discharge electrodes have the same diameter.

14. The apparatus according to claim 1, wherein said two air passages are mounted in a spaced apart relation within a common block.

* * * * *

UNITED STATES PATENT AND TRADEMARK OFFICE

CERTIFICATE OF CORRECTION

PATENT NO. : 5,095,400

DATED : March 10, 1992

INVENTOR(S) : Saito

It is certified that error appears in the above-identified patent and that said Letters Patent is hereby corrected as shown below:

In column 10, line 12, amend "claim 1" to --claim 2--.

Signed and Sealed this

Fourteenth Day of September, 1993

Bruce Lehman

*Attest:*

BRUCE LEHMAN

*Attesting Officer*

*Commissioner of Patents and Trademarks*